US006601890B1

(12) United States Patent
Firth

(10) Patent No.: US 6,601,890 B1
(45) Date of Patent: Aug. 5, 2003

(54) CYLINDER LIFTING SLING AND METHOD FOR MAKING THE SAME

(75) Inventor: David G. Firth, Seattle, WA (US)

(73) Assignee: Safe Shop Tools, Inc., Missoula, MT (US)

( * ) Notice: Subject to any disclaimer, the term of this patent is extended or adjusted under 35 U.S.C. 154(b) by 0 days.

(21) Appl. No.: 09/724,688

(22) Filed: Nov. 28, 2000

(51) Int. Cl.[7] ..... B66C 1/12

(52) U.S. Cl. ..... 294/74; 294/82.14; 294/150; 248/317

(58) Field of Search ..... 294/74, 82.14, 294/150, 156; 24/198; 2/311, 312, 320; 224/264; 248/59, 60, 74.3, 317, 693; 474/205

(56) References Cited

U.S. PATENT DOCUMENTS

| | | | | | |
|---|---|---|---|---|---|
| 892,105 | A | * | 6/1908 | White | 248/60 |
| 1,102,803 | A | * | 7/1914 | Dravo | 294/74 |
| 1,168,802 | A | * | 1/1916 | Harrison | 294/74 |
| 1,490,066 | A | * | 4/1924 | Carr | 294/74 |
| 1,824,027 | A | * | 9/1931 | Lundquist | 294/74 |
| 2,598,921 | A | * | 6/1952 | Knudsen | 294/74 |
| 2,903,291 | A | * | 9/1959 | Barthule | 294/74 |
| 2,985,480 | A | * | 5/1961 | Otley | 294/74 |
| 3,352,590 | A | * | 11/1967 | Barthule | 294/74 |
| 3,368,837 | A | * | 2/1968 | Norton | 294/74 |
| 3,372,439 | A | * | 3/1968 | Schmid | 248/60 |

(List continued on next page.)

FOREIGN PATENT DOCUMENTS

| | | | | |
|---|---|---|---|---|
| DE | 4018584 | * | 12/1991 | |
| GB | 767014 | * | 1/1957 | 224/5 P |
| JP | 406213283 | * | 8/1994 | 474/205 |
| SU | 0969636 | * | 11/1982 | 294/74 |

OTHER PUBLICATIONS

"Trx–Coated Nylon Web Slings" Bulletin from Lift–All Company, Inc.*

"Gripper Woven Wire Sling" Catalog by the Cambridge Wire Cloth Co.*

Instructions for use of a NESCO Tote for carrying cylinders, published by Northwestern Equipment & Supply Co (published circa more than one year prior to filing of the present application).

Mark Safety Co. LLC on–line catalog, http://cornerpost.com/marksafety/Brochure.html (Nov. 2000) (1 page).

Mark Safety Co. LLC on–line catalog, http://marksafety.com (Nov. 1999) (2 pages).

Mark Safety Co. LLC on–line catalog, http://marksafety.com/zoom_on_lift.htm (Nov. 1999) (1 page).

Mark Safety Co. LLC on–line catalog, http://marksafety.com/zoom_on_hilolift.htm (Nov. 1999) (1 page).

Mark Safety Co. LLC on–line catalog, http://marksafety.com/zoom_on_cart.htm (Nov. 1999) (1 page).

Scott Medical Products online catalog, http://scottgas.com/medical/cylbrack.htm (Sep. 2000) (1 page).

*Primary Examiner*—Eileen D. Lillis
*Assistant Examiner*—Paul T. Chin
(74) *Attorney, Agent, or Firm*—Klarquist Sparkman, LLP

(57) ABSTRACT

A lifting sling and a method for making the same are disclosed. The lifting sling comprises an elongated, flexible member having a working surface, a lifting end portion for attaching to a lifting mechanism and a choker end portion. A plurality of longitudinally spaced apart gripping members are attached to the working surface of the flexible member for frictionally engaging the outer surface of a load being lifted. To make the lifting sling, the flexible member is laid on the face of a mold having cavities for forming the gripping members. Liquid casting material is introduced into the mold cavities and allowed to penetrate the surface of the flexible member for permanent bonding thereto.

1 Claim, 3 Drawing Sheets

U.S. PATENT DOCUMENTS 3,625,559 A * 12/1971 Lawrence ..... 294/74
3,776,585 A * 12/1973 Bridgehouse ..... 294/74
4,025,100 A * 5/1977 Bridgehouse ..... 294/74
4,116,374 A 9/1978 Garello ..... 294/150
4,165,774 A * 8/1979 Matsui ..... 152/221
4,287,925 A * 9/1981 Spann ..... 152/221
4,486,044 A 12/1984 Gordon et al. ..... 294/31.2
4,856,836 A 8/1989 Delphin ..... 294/74
4,905,950 A * 3/1990 Turner et al. ..... 24/273
4,988,070 A * 1/1991 Hollinger et al. ..... 294/82.14
5,160,105 A * 11/1992 Miller ..... 248/188.9
5,498,047 A * 3/1996 Treuling ..... 294/74
5,556,146 A 9/1996 Kirk ..... 294/31.2
5,584,452 A * 12/1996 Koike ..... 248/74.3
5,598,995 A * 2/1997 Meuth et al. ..... 248/74.3
5,688,011 A 11/1997 Gulley ..... 294/74
5,695,102 A * 12/1997 Jackson ..... 224/264
5,848,865 A * 12/1998 Beals ..... 410/99
6,115,849 A * 9/2000 Meyerrose ..... 2/428
6,149,215 A * 11/2000 Balogh et al. ..... 294/74
6,253,421 B1 * 7/2001 Kraus ..... 248/74.3
6,325,339 B1 * 12/2001 Lewis ..... 248/74.1

* cited by examiner 12
36
18
16
10
20
25
14

CYLINDER LIFTING SLING AND METHOD FOR MAKING THE SAME

FIELD

The present invention concerns lifting slings for lifting, holding or otherwise manipulating heavy articles.

BACKGROUND

Previous inventions have been designed for the carrying or lifting gas cylinders. One such device is disclosed in U.S. Pat. No. 5,556,146 issued to Kirk, which describes a metal hoop having a handle. The metal hoop, which is sized slightly larger than the diameter of a cylinder to be lifted, is slipped around the cylinder so that when the cylinder is lifted by the handle, the hoop retains the cylinder through frictional contact on the bottom and top of the device. This device, however, is disadvantageous in that it is suitable for lifting cylinders of only one size, the metal hoop tends to damage the surface finish of cylinders, and it is susceptible to slipping.

Conventional nylon web slings configured to have a choker mechanism at one end also have been used to lift gas cylinders. In such a device, one end of the sling is threaded through the choker to form an adjustable loop which is then placed around the cylinder to be lifted. The loop is tightened around the cylinder and the free end of the sling is connected to a lifting mechanism, such as a load hook or a forklift tine. As the lifting mechanism is raised, the sling is pulled taught, causing the loop to frictionally engage the outer surface of the cylinder and lift the cylinder. Nylon slings are desirable because they can be adjusted to fit around a cylinder of any size and do not damage the surface finish of the cylinder. The use of nylon slings, however, is limited because the coefficient of friction provided by the nylon may not be sufficient to adequately grip heavy or wet cylinders.

One device attempts to improve upon the inadequate frictional properties of nylon by encasing a nylon strap in an elastomeric sleeve. Although the sleeve increases gripping capability, this type of sling proves to be difficult to use when handling metal cylinders. When a loop is formed and tightened around a cylinder, the elasticity of the sleeve causes the loop to lose the shape of the cylinder unless tension is maintained on the sling. As a result, an operator must maintain the loop with one hand while simultaneously operating the lifting mechanism with his other hand until there is sufficient tension in the sling to grip the cylinder. This practice is cumbersome and may lead to operator injury. The elastomeric-sleeved lifting sling is also undesirable in that the sleeve produces unwanted surface friction against the choker mechanism as slack is removed from the loop.

Therefore, a need exists for a new and improved lifting sling that overcomes the foregoing and other disadvantages of the prior art.

SUMMARY

The disclosed embodiments of the present invention seek to overcome the foregoing problems of the prior art by providing an improved lifting sling for lifting and moving heavy loads, such as cylinders containing pressurized gas. According to one embodiment of the present invention, a lifting sling comprises an elongated, flexible member having a working surface, a lifting end portion for attaching to a lifting mechanism and a choker end portion. A plurality of longitudinally spaced apart gripping members are attached to the working surface of the member for frictionally engaging the outer surface of the load to be lifted. The sling preferably includes a choker ring fastened to the choker end portion through which the lifting end portion may be inserted to form an adjustable loop with a variable diameter to fit around the outer surface of a load of any size or configuration.

When lifting or otherwise moving a load with the sling, the sling should be configured to form an adjustable loop, as previously described, which is placed about the load. The size of the loop is adjusted to contact a surface of the load by manually tensioning the sling in a direction away from the load until the loop fits snugly around the outer surface of the load. The lifting end portion, which is secured to a lifting mechanism, is moved in a direction away from the load to remove the slack from the sling. As the sling is pulled, tension in the sling is converted to a circumferential gripping force about the load and the load is lifted The foregoing features and advantages of the present invention are described further in the following detailed description, which proceeds with reference to the accompanying drawings.

DETAILED DESCRIPTION

Figure 1:
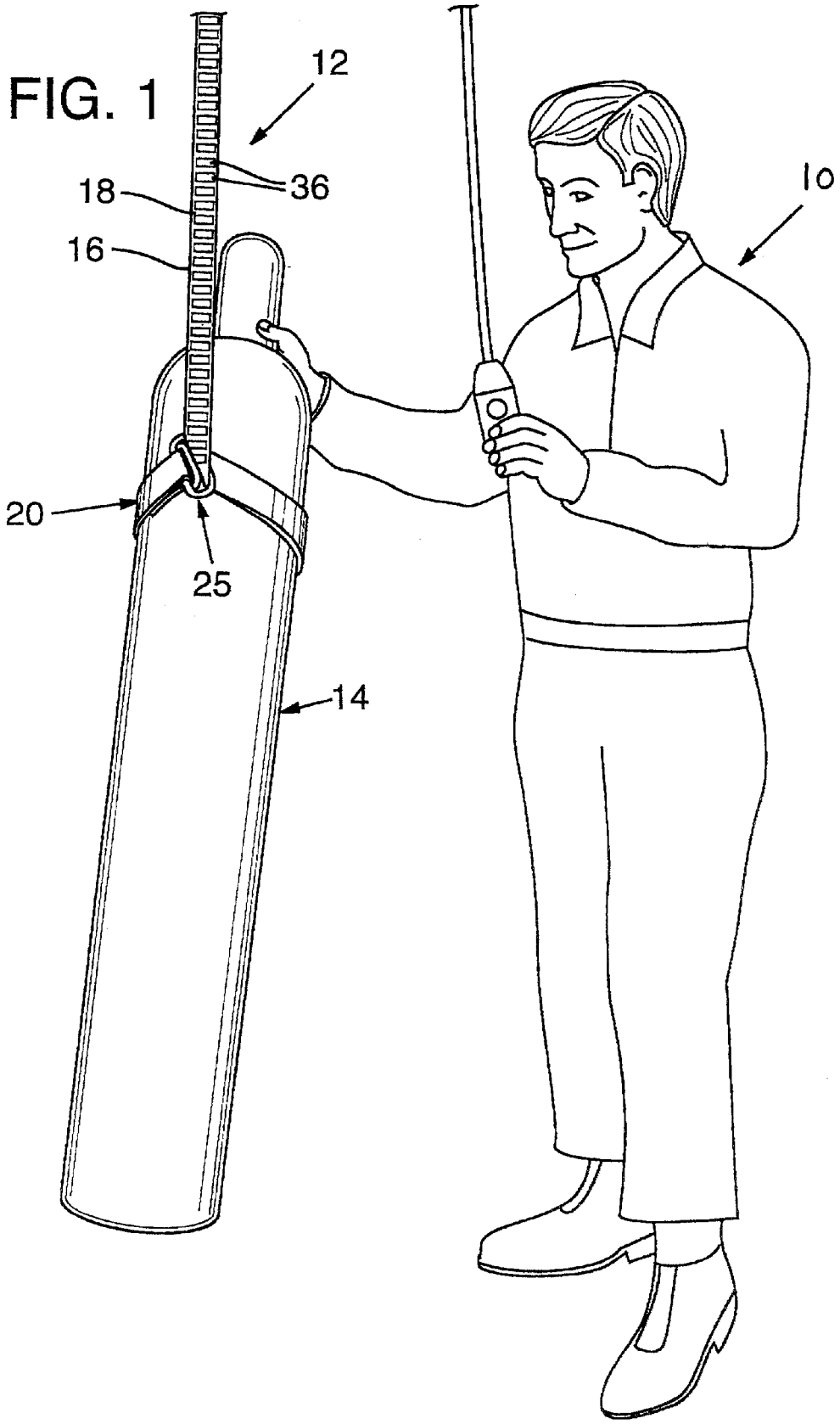
FIG. 1 is a perspective view of an operator lifting a gas cylinder with a working embodiment of a lifting sling according to the present invention.

Referring to FIGS. 1–4, a working embodiment of a lifting sling 12 is illustrated. As shown in FIG. 1, the lifting sling 12 may be used by an operator 10 to lift and move a load, such as the illustrated gas cylinder 14. The manner in which the lifting sling 12 is used to move a load is described in greater detail below.

Lifting sling 12 comprises an elongated, flexible member 16 having a working surface 18, a choker end portion 20 and a lifting end portion 22. Member 16 may be constructed of any flexible material having a strength sufficient to avoid failure under the weight of a load to be lifted. For reasons which will become apparent, it is preferred that member 16 comprise a material having a permeable surface, such as a fabric or fabric-like material, to permit fabrication of the sling 12 according to the manufacturing method described herein. Conventional two-inch wide nylon webbing or nylon strapping was found to be a suitable material for member 16, although wider nylon webbing also may be used.

Figure 3:
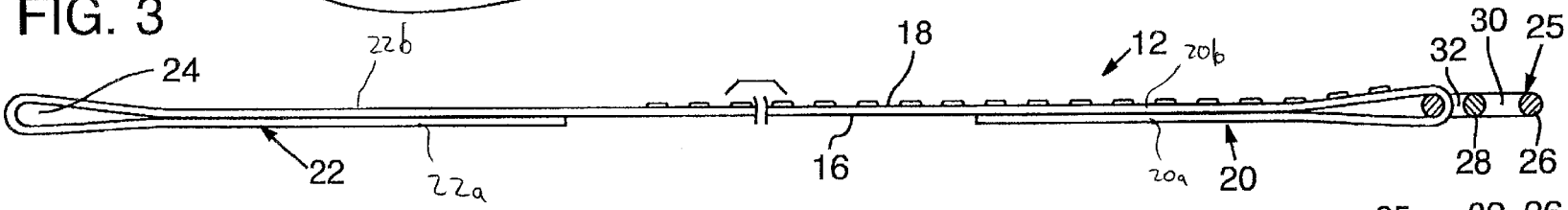
FIG. 3 is a cross sectional side view showing the lifting sling of FIG. 1 before it is configured to form an adjustable loop.
Figure 4:
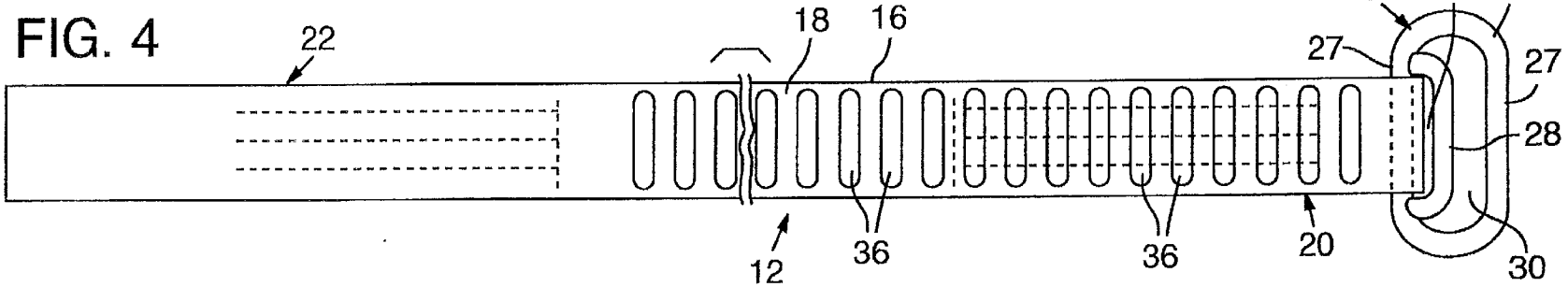
FIG. 4 is a top plan view showing the lifting sling of FIG. 1 before it is configured to form an adjustable loop.
Figure 5:
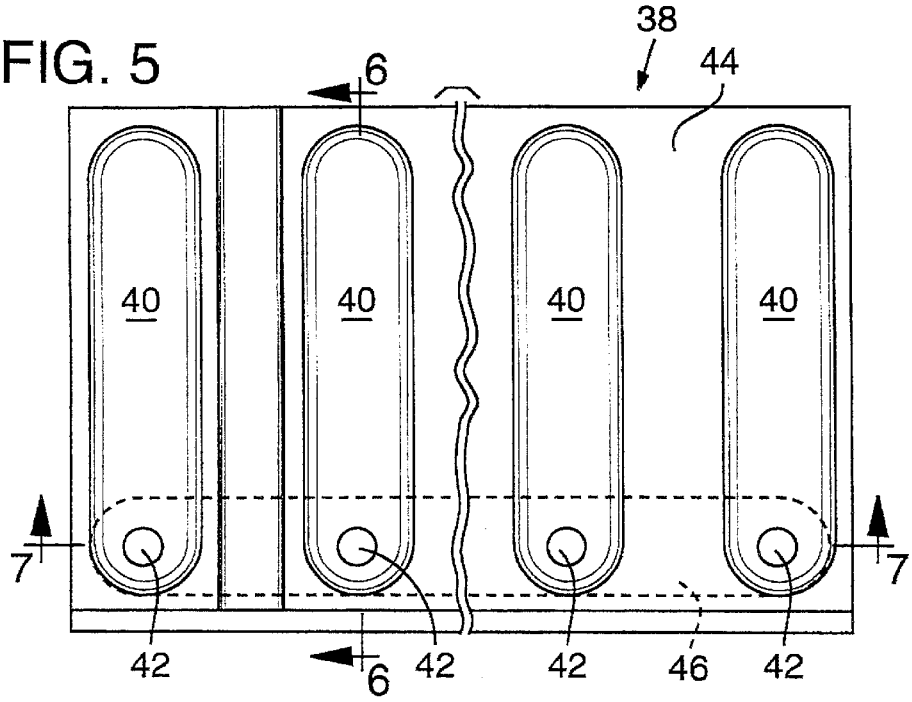
FIG. 5 is a top plan view of a mold used to make the lifting sling illustrated in FIGS. 1–4.

As best shown in FIG. 3, a loop 24 is integrally formed in the lifting end portion 22 by folding the terminal end 22*a* of the lifting end portion back and onto an adjacent part 22*b* of the lifting end portion, and then fastening together the terminal end 22*a* and the adjacent part 22*b* of the lifting end portion, such as by stitching. The loop 24 is sized so as to fit around a conventional lifting mechanism (not shown), such as a load hook or a forklift tine.

Figure 2:
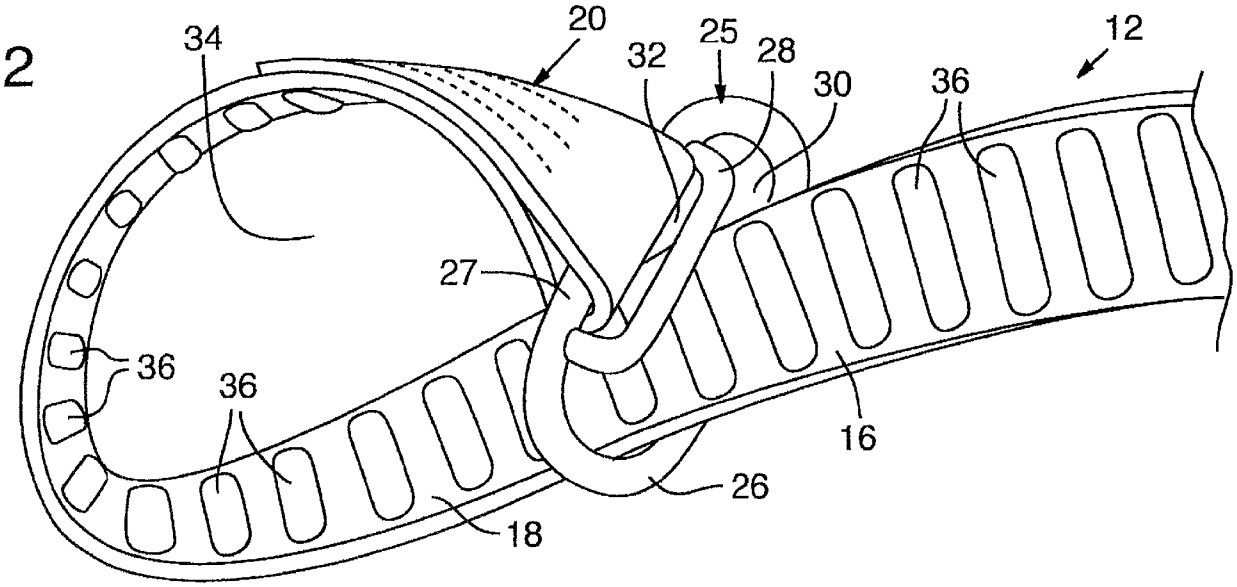
FIG. 2 is an enlarged perspective view showing the adjustable loop that is formed with the lifting sling of FIG. 1.

Secured to the choker end 20 of member 16 is a choker ring 25. A disclosed embodiment comprised a first link 26 and second link 28 mounted to the first link 26 in any conventional manner, such as by welding. In the illustrated embodiment, the first link 26 is generally elliptical in shape with oblate side portions 27 and the second link 28 is welded to one of the side portions 27 inside the first link so as to form first and second apertures 30 and 32. As best illustrated by FIG. 2, member 16 is fastened to the choker ring 25 in a working embodiment by extending the terminal end 20*a* of choker end portion 20 through the second aperture 32, looping the terminal end 20*a* back unto an adjacent part 20*b* of the choker end portion and coupling together the terminal end 20*a* and the adjacent part 20*b* in a conventional manner, such as by stitching or rivets. The second aperture 32 generally is dimensioned to be only slightly larger than the width of the choker end portion 20, the significance of which will be explained below in the description of the sling's operation. As further shown in FIG. 2, the first aperture 30 of the choker ring 25 is of sufficient size such that the lifting end portion 22 of member 16 may be slidably inserted therethrough to create an adjustable loop 34 of variable diameter that is adjustable to fit around, and configure to, the outer surface of a load of any size or configuration.

A plurality of longitudinally spaced, elastomeric gripping members 36 are secured to the working surface 18 of member 16 to provide the necessary gripping force when the adjustable loop 34 is placed around a load for lifting. By spacing the gripping members 36 along the length of the sling 12, the flexibility of member 16 is maintained to effect proper setting of the loop around the cylinder without maintaining tension on the sling. It has been found that the proper dimensions and spacing for the gripping members 36 are those which maximize surface area of the gripping members and provide for adequate flexibility of the sling for the particular load being lifted. For example, where less flexibility is required, such as when lifting a load having a relatively large radius of curvature, the widths of the gripping members may be increased and spacing between gripping members may be decreased so as to increase the overall surface area of the gripping members 36. Conversely, when lifting a load having a relatively small radius of curvature, the widths of the gripping members should be decreased and spacing between gripping members should be increased to provide a sling that is more flexible. In a working embodiment sized for lifting commercial gas cylinders, each gripping member 36 is preferably about 0.4 inches in width, about 1.7 inches in length, and is spaced approximately 0.35 inches from an adjacent gripping member. These dimensions were found to work best for safely lifting gas cylinders of about 7 to 15 inches in diameter and weighing up to 500 pounds. Of course, larger diameter and/or heavier cylinders may be lifted by increasing the size of the gripping members 36.

The gripping members 36 are made of a material capable of providing sufficient frictional contact with the surface of a load to grip and lift the load when the sling 12 is pulled taut. In addition, the gripping members 36 should be constructed of a material that is sufficiently elastic so as to conform to any irregularities on the load surface and not damage the surface finish of the load. For example, many of the commercially available thermoplastic and thermosetting elastomers would be suitable for use in the present invention. In particular, molded polyurethane, such as product number PMC-746, manufactured by Smooth-On, Incorporated of Easton, Pa., was found to be an exemplary material for the gripping members in a working embodiment. Tests have shown that molded polyurethane provides a gripping force for lifting loads of up to 2,000 pounds without slipping.

When lifting or otherwise moving a load with the sling 12, the sling must be first configured to form an adjustable loop 34, as previously described, which is then placed around the load, such as around cylinder 14. The adjustable loop 34 is then set in place by manually tensioning the sling in a direction away from the load until the loop fits snugly around the outer surface of the load. At this point, tension may be released because the gripping members 36 provide sufficient traction to prevent the loop 34 from slipping once the loop has been set. Thus, an operator is permitted to operate the lifting mechanism without having to simultaneously maintain tension in the loop 34 until enough slack has been removed by the lifting mechanism to prevent premature slippage of the loop 34. It therefore should be appreciated that handling of a load with the present invention may be easily accomplished by one operator. Further, the illustrated embodiment of the invention reduces the possibility of serious injury, as the operator is able to operate the lifting mechanism at a safe distance from the load being lifted.

After the adjustable loop 34 has been set and the lifting loop 24 has been placed around a lifting mechanism, the lifting mechanism is moved in a direction away from the load to remove slack from the sling 12. As the sling 12 is pulled, the tension in the sling is converted to a circumferential gripping force around the surface of the load. This is referred to as the "acquisition stage" of the lifting process. Once the sling 12 is pulled taut under the weight of the cylinder, the load is lifted off the ground due to the frictional contact between the gripping members 36 and the surface of the load. Because the second aperture 32 is sized to be only slightly larger than the width of the choker end portion 20, the choker ring 25 is prevented from rotating relative to the choker end portion 20 as tension is applied in the upward direction (as shown in FIG. 1). Therefore, the choker end portion 20 and the portion of the sling 12 in the first aperture 30 maintain contact with the oblate side portions 27 to provide a smooth upward transition from the acquisition stage to the actual lifting of the load.

Referring now to FIGS. 5–8, a mold 38 is illustrated for casting the gripping members 36. The mold 38, the length of which generally is equal to the length of the sling 12, has a plurality of longitudinally spaced mold cavities 40, each of which forms an individual gripping member 36. In the alternative, a series of individual molds having a cavity similar to cavities 40 wherein each individual mold corresponds to a gripping member 36 may be employed rather than using a single mold having multiple cavities.

Figure 6:
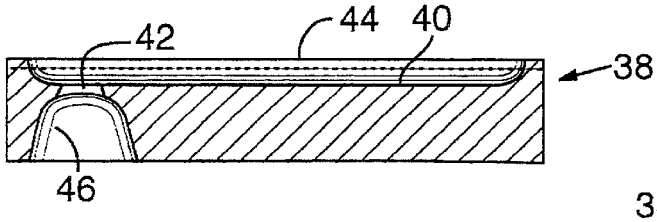
FIG. 6 is a cross sectional view of the mold of FIG. 5 taken along line 6—6.
Figure 7:
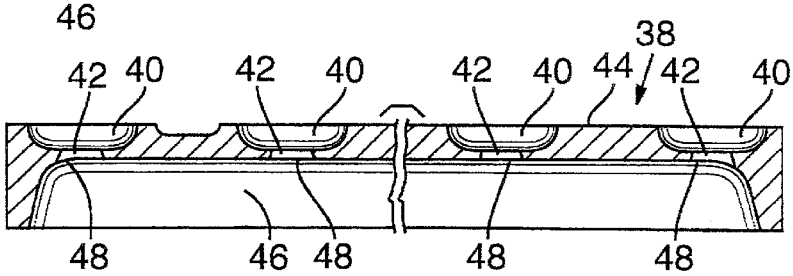
FIG. 7 is a cross sectional view of the mold of FIG. 5 taken along line 7—7.
Figure 8:
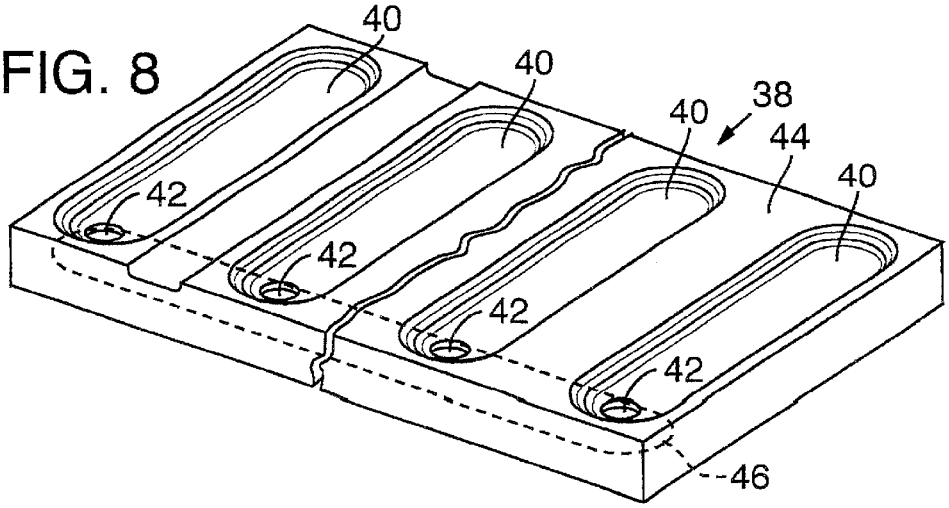
FIG. 8 is a perspective view of the mold of FIG. 5.

The molding process has been accomplished as follows. Member 16 made of conventional two inch nylon webbing material is laid on the face 44 of the mold 38 and held in place by a clamping mechanism (not shown). Liquid casting material, which is poured into a longitudinally extending reservoir 46, flows into each of the mold cavities 40 through gates 42. As shown in FIGS. 6 and 7, the gates 42 taper outwardly from the mold cavities 40 to the reservoir 46 to facilitate removal of the mold 38 once the casting material has cured. After the cavities 40 have been filled with casting material, the casting material is allowed to cure. The casting material penetrates the surface of the nylon webbing material so that the gripping members become permanently secured to the webbing material when cured.

The proper temperature and time required for adequate curing will vary depending on the casting material and the dimensions of each gripping member. When using the type of polyurethane available from Smooth-On, Incorporated as mentioned above, it has been found that the mold should be cured for about 1 hour at approximately 130° Fahrenheit to form gripping members that are 1.7 in length, 0.4 in width and 0.09 in thickness. Once the casting material has cured, the clamping mechanism is removed and the mold is separated from the sling.

In addition to the molding technique described above, it should be appreciated that other conventional methods of molding, such as injection molding, may be employed to form the gripping members.

Whereas the invention has been described in connection with a representative embodiment, it will be apparent that the invention is not limited to that embodiment. On the contrary, the invention is intended to encompass all modifications, alternatives, and equivalents as may be included within the spirit and scope of the invention, as defined by the appended claims.

I claim:

1. A lifting sling apparatus comprising:

an elongated, flexible member comprising a working surface, a lifting end portion having a first width, and a choker end portion;

a first link defining a first aperture of a size larger than the width of the choker end portion, the choker end portion extending through the first opening and looped back unto itself with the adjacent parts of the choker end portion being fastened together;

a second link connected to the first link and defining a second aperture through which the lifting end portion is slidably insertable such that the member forms an adjustable loop with a variable diameter to fit around the outside surface of a load to be lifted; and a plurality of longitudinally spaced, elastomeric gripping members attached at fixed points to the working surface of the member, each gripping member having an outer surface for directly contacting the outside surface of the load when the loop is placed around the load.

* * * * *